US010269196B1

(12) United States Patent
Fernandez

(10) Patent No.: US 10,269,196 B1
(45) Date of Patent: Apr. 23, 2019

(54) ACCESS CONTROL BASED ON RHYTHMIC PATTERN REPETITION

(71) Applicant: United Services Automobile Association (USAA), San Antonio, TX (US)

(72) Inventor: Amanda S. Fernandez, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 0 days.

(21) Appl. No.: 15/976,220

(22) Filed: May 10, 2018

Related U.S. Application Data

(63) Continuation of application No. 15/641,821, filed on Jul. 5, 2017, now Pat. No. 10,002,474.

(60) Provisional application No. 62/361,115, filed on Jul. 12, 2016.

(51) Int. Cl.
*G07C 9/00* (2006.01)

(52) U.S. Cl.
CPC ..... *G07C 9/00007* (2013.01); *G07C 9/00309* (2013.01); *G07C 2009/00769* (2013.01)

(58) Field of Classification Search
CPC ..... G07C 9/00007; G07C 9/00309
USPC ..... 340/5.5–5.54
See application file for complete search history.

(56) References Cited

U.S. PATENT DOCUMENTS

| | | | | |
|---|---|---|---|---|
| 9,510,357 | B1 | 11/2016 | Egner | |
| 2008/0114501 | A1 | 5/2008 | Wu | |
| 2015/0296480 | A1* | 10/2015 | Kinsey | H04W 4/80 455/41.3 |
| 2016/0179877 | A1 | 6/2016 | Koerner | |
| 2016/0292584 | A1 | 10/2016 | Weinberg | |
| 2016/0360336 | A1 | 12/2016 | Gross | |
| 2016/0360382 | A1 | 12/2016 | Gross | |
| 2018/0085014 | A1* | 3/2018 | Murakami | A61B 5/0062 |

* cited by examiner

*Primary Examiner* — Allen T Cao
(74) *Attorney, Agent, or Firm* — Fish & Richardson P.C.

(57) ABSTRACT

Techniques are described for controlling access based on pattern repetition. A rhythmic pattern may be communicated to a portable computing device of an individual, and played on the device using haptic and/or audio output. In response to the played pattern, the individual may attempt to repeat the pattern by tapping on a touchpad or other haptic input on a computing device. The entered pattern may be compared to the original pattern and, if the patterns correspond, the individual may be provided with requested access to a secure area and/or secure data. In some implementations, the pattern repetition technique may be employed to unlock a secure device based on a rhythmic pattern received at a different device such as an epidermal patch or other wearable computer.

20 Claims, 6 Drawing Sheets

ACCESS CONTROL BASED ON RHYTHMIC PATTERN REPETITION

CROSS-REFERENCE TO RELATED APPLICATION

This application is a continuation application of and claims priority to U.S. application Ser. No. 15/641,821, filed on Jul. 5, 2017, which is related to, and claims priority to, U.S. Provisional Patent Application Ser. No. 62/361,115, titled "Access Control Based On Rhythmic Pattern Repetition," which was filed on Jul. 12, 2016, the entirety of which are incorporated by reference into the present disclosure.

BACKGROUND

Organizations and individuals that operate and/or manage computing systems may implement various security measures to prevent unauthorized individuals from accessing secure physical spaces, devices, applications, and/or data. Traditionally, a user may provide one or more credentials to gain access to a computing system, such as a username, password, and/or personal identification number (PIN). Credentials such as a PIN, keycard, or radio frequency identification (RFID) tag may also be used to access a secure area, e.g., by swiping a keycard through a scanner to open a door to the area. By comparing the supplied credentials with previously established credentials for the user, a determination may be made whether to permit or deny the requested access.

SUMMARY

Implementations of the present disclosure are generally directed to authentication and/or controlling access to a secure area or secure information. More specifically, implementations are directed to controlling access to a secure area and/or secure information based on rhythmic pattern repetition.

In general, innovative aspects of the subject matter described in this specification can be embodied in methods that include actions of: receiving, from a user device, an access request to access a secure area and, in response, sending a first pattern to be output through the user device, the first pattern including a plurality of pulses; receiving, from a pattern entry device, a second pattern that is entered through the pattern entry device as an attempt to repeat the first pattern; and based at least partly on a correspondence between the first pattern and the second pattern, approving the access request and sending an access signal to provide access to the secure area.

Implementations can optionally include one or more of the following features: the first pattern is output on the user device as one or more of a haptic output and an audio output; the pattern entry device includes a touch interface; the second pattern is generated by the individual tapping on a touch interface; the actions further include determining a differential between the first pattern and the second pattern; the actions further include determining the correspondence between the first pattern and the second pattern based on the differential being at or below a threshold value; the first pattern includes a plurality of groups of pulses; the second pattern includes a sequence of a plurality of numbers that each corresponds to a number of pulses in one of the plurality of groups; the access request is to access the secure area that is secured by a door; sending the access signal instructs a door controller to open the door; the access request is to access at least a portion of an application; sending the access signal enables the individual to access at least the portion of the application; the user device is a wearable computing device in physical contact with the individual; and/or the first pattern is output by the user device as a haptic output that is perceivable by the individual.

Other implementations of any of the above aspects include corresponding systems, apparatus, and computer programs that are configured to perform the actions of the methods, encoded on computer storage devices. The present disclosure also provides a computer-readable storage medium coupled to one or more processors and having instructions stored thereon which, when executed by the one or more processors, cause the one or more processors to perform operations in accordance with implementations of the methods provided herein. The present disclosure further provides a system for implementing the methods provided herein. The system includes one or more processors, and a computer-readable storage medium coupled to the one or more processors having instructions stored thereon which, when executed by the one or more processors, cause the one or more processors to perform operations in accordance with implementations of the methods provided herein.

Implementations of the present disclosure provide one or more of the following technical advantages and/or technical improvements over previously available solutions. By providing access based on the individual's repetition of a rhythm pattern received at a portable computing device, implementations provide an access control technique that is unobtrusive and easy from the perspective of the individual requesting access, with minimal effort required from the individual. This provides a more positive user experience compared to traditional techniques in which the individual may be required to remember and enter a personal identification number (PIN) and/or other credential(s) that were previously assigned to the individual. Implementations may be especially helpful to children, individuals with memory impairment, and/or other individuals who may have difficulty remembering traditional credentials such as a password or PIN. Implementations also provide a more positive user experience compared to traditional techniques that may require the individual to carry a cardkey, radio frequency identification (RFID) tag, or other physical token to gain access to a physical space, given that such tokens may be cumbersome to carry and may be readily lost or stolen. Implementations provide a more secure access control system compared to systems that require traditional user credentials (e.g., password, PIN, etc.), given that such traditional credentials may be guessed or stolen. By playing a rhythmic pattern that is dynamically generated when the individual is requesting access, and by requiring the individual to reproduce the pattern at an access touchpad or through their mobile device, implementations provide an access control technique that is more secure and less vulnerable to spoofing or theft compared to traditional access control methods.

Implementations provide further technical improvements and advantages over traditional access control systems. Because traditional access control systems may require users to accurately remember and enter user credentials (e.g., PIN, etc.), traditional systems are susceptible to failed access requests caused by wrong, mistyped, or forgotten credentials. By providing an access control technique that does not require the user to accurately remember and enter credentials, implementations may reduce or eliminate failures. Accordingly, implementations avoid the expenditure of processing capacity, memory, storage space, network bandwidth, and/or other computing resources that traditional systems need to expend to recover from failed access attempts. Moreover, implementations also provide an advantage over authentication based on biometric data (e.g., identification based upon physical characteristics). Because biometric data may change slowly, or not change over time (e.g., as with fingerprints), acquisition of the biometric data may enable an unauthorized user to gain access to systems by pretending to be the authorized user. Because the rhythm pattern may vary with each instance, authentication based on repeating the pattern may be less vulnerable to impersonation than traditional authentication modes.

It is appreciated that aspects and features in accordance with the present disclosure can include any combination of the aspects and features described herein. That is, aspects and features in accordance with the present disclosure are not limited to the combinations of aspects and features specifically described herein, but also include any combination of the aspects and features provided.

The details of one or more implementations of the present disclosure are set forth in the accompanying drawings and the description below. Other features and advantages of the present disclosure will be apparent from the description and drawings, and from the claims.

DETAILED DESCRIPTION

Figure 1A:
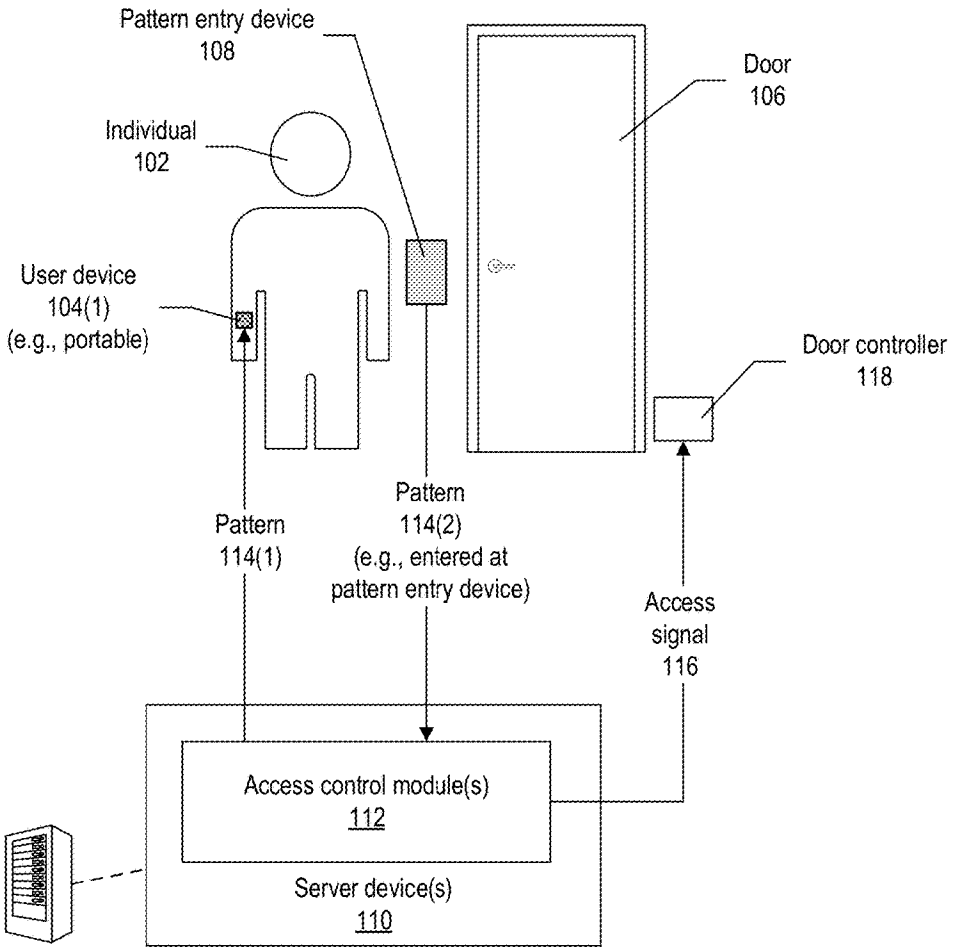
FIG. 1A depicts an example system for using pattern repetition to control access to a secure area, according to implementations of the present disclosure.

Implementations of the present disclosure are directed to systems, devices, methods, and computer-readable media for controlling access based on pattern repetition. In some implementations, a rhythmic pattern may be communicated to a portable computing device of an individual. The rhythmic pattern may include a plurality of pulses arranged in a particular rhythm. The portable computing device may be configured with haptic actuator(s), audio output(s) (e.g., speakers), and/or other components that are suitable for playing the rhythmic pattern as a pattern of vibrations and/or sounds that are perceivable by the individual. In some implementations, the rhythmic pattern may be played using an epidermal patch computing device that is configured to vibrate with each pulse in the pattern. In some implementations, the epidermal patch computing device may output an electric current that is perceived by the individual as the pattern of pulses through nerve induction.

In response to the played pattern, the individual may attempt to repeat the pattern by tapping on a touchpad or other haptic input on a computing device. The entered pattern may be compared to the original pattern and, if the patterns correspond, the individual may be provided with the requested access. In some examples, the touchpad may be proximal to a door or other controlled entryway to a secure area, and the door may be opened if the individual repeats the pattern with sufficient accuracy. In some examples, the touchpad may be on a user device such as a smartphone, tablet, and so forth. In response to a sufficiently accurate repetition of the pattern, the individual may be granted access to an application, or to a secure portion of the application, executing on the user device. As another example, the user device may be unlocked if the individual provides a sufficiently accurate repetition of the pattern. Accordingly, the pattern repetition technique may be employed to unlock a secure device based on a rhythmic pattern received at a different device (e.g., an epidermal patch or other wearable computer).

By providing access based on the individual's repetition of a rhythm pattern received at a portable computing device, implementations provide an access control technique that is unobtrusive and easy from the perspective of the individual requesting access, with minimal effort required from the individual. This provides a more positive user experience compared to traditional techniques in which the individual may be required to remember and enter a personal identification number (PIN) and/or other credential(s) that were previously assigned to the individual. Implementations also provide a more positive user experience compared to traditional techniques that may require the individual to carry a cardkey, radio frequency identification (RFID) tag, or other physical token to gain access to a physical space. Traditional user credentials (e.g., password, PIN, etc.) may be guessed or stolen, and traditional physical tokens (e.g., cardkey, RFID tag, etc.) may be stolen. By playing a rhythmic pattern that is dynamically generated when the individual is requesting access, and by requiring the individual to reproduce the pattern at an access touchpad or through their mobile device, implementations provide an access control technique that is more secure and less vulnerable to spoofing or theft compared to traditional access control methods.

FIG. 1A depicts an example system for using pattern repetition to control access to a secure area, according to implementations of the present disclosure. In the example of FIG. 1A, an individual 102 is attempting to access a secure space (e.g., home, office, ATM vestibule, etc.) through a door 106. The individual 102 may have a portable user device 104, such as a smartphone, tablet, wearable computer, implanted computer, and so forth. In the example of FIG. 1A, the individual 102 has a user device 104(1) that is a wearable computer such as an epidermal patch computing device that adheres to the individual's skin. The user device 104(1) may include components for receiving a communication such as the pattern 114(1). The user device 104(1) may also include haptic actuators and/or other components that enable the user device 104(1) to play the pattern 114(1) as described further below. The system may include a pattern entry device 108 in proximity to the door 106.

The system may include one or more server devices 110 that execute one or more access control modules 112. The server device(s) 110 may include any suitable number and type of computing devices. In some examples, the server device(s) 110 may be remote from the user device 104(1)

and/or the door 106, and may communicate with the user device 104(1) and/or a door controller 118 over one or more networks.

In response to a determination that the user device 104(1) and/or individual 102 is in proximity to the door 106, the access control module(s) 112 may generate and send a pattern 114(1) to the user device 104(1). For example, the access control module(s) 112 may receive from the user device 104(1) and/or other user device 104 (e.g., smartphone) location information that indicates the location of the user device(s) 104. The location may be determined through a satellite-based navigation system, such as the global positioning system (GPS), or through other methods. The access control module(s) 112 may receive the location information and determine that the individual 102 is within a threshold distance of the door 106 and/or is approaching the door 106. Based on the location information, the access control module(s) 112 may infer that the individual 102 intends to pass through the door 106 into the secure area beyond the door 106. Accordingly, the location information itself may be the individual's request to access the secure area. In some implementations, the individual 102 may explicitly send a request by entering a command through their user device 104, the pattern entry device 108, and/or other interface.

On receiving the pattern 114(1), the user device 104(1) may play the pattern 114(1) as a series of pulses that are perceivable by the individual 102 as vibrations to the individual's skin or other body part(s). As used herein, haptic output refers to an effect that may be perceived by the individual 102 as a vibration, motion, and/or other sensation. The user device 104(1) may include one or more haptic actuators that output the pattern 114(1). Implementations support any suitable type of the haptic actuator(s) that use any suitable type of haptic effects generating technology. In some implementations, the haptic actuator(s) employ a unified mass or inertial mode excitation technology, which employ a mass that is suspended in a cavity. The mass may be accelerated or decelerated to create a pulsive force that is perceivable to the user as a vibration of the user device 104(1). The acceleration or deceleration may be in an X-Y plane of a surface of the device (e.g., in a shear direction), or in a Z-direction orthogonal to an X-Y plane. The haptic actuator(s) may also employ other methods for generating haptic effects, including coefficient of friction modulation actuators, electroactive polymer actuators, electrostatic repulsion actuators, haptic actuators based on piezoelectric materials, and/or other haptic effect generation technologies.

In some implementations, the user device 104(1) may include haptic actuator(s) that output an electric current to cause neuromuscular electrical stimulation that creates a haptic (or pseudo-haptic) effect perceivable by the individual 102. The current may travel through the individual's body and stimulate nerves that create a sensation of a vibration in the individual 102. In some implementations, the user device 104(1) may be worn by the individual 102 in a particular location on their body that is suitable for playing a pattern 114(1) using neuromuscular electrical stimulation. For example, the user device 104(1) may be an epidermal patch device that is affixed to the individual 102 in proximity to the individual's median nerve to achieve optimal pseudo-haptic effect. In some implementations, the user device 104(1) may play the pattern 114(1) as a series of audio pulses, or as a combination of audio pulses and vibrational (haptic) pulses.

In some implementations, the individual 102 may attempt to repeat the pattern 114(1) by tapping onto a pattern entry device 108. The tapped pattern 114(2) may be communicated to the access control module(s) 112, which may compare the tapped pattern 114(1) to the originally communicated pattern 114(2). If the patterns sufficiently correspond to one another, access may be granted. In such instances, the access control module(s) 112 may cause an access signal 116 to be communicated from the server device(s) 110 to the door controller 118 over one or more networks. The door controller 118 may respond to the access signal 116 by opening the door 106 and allowing the individual 102 to access the secure area. The door controller 118 may include any suitable number and type of components to open a door, such as mechanical, electrical, hydraulic, pneumatic, and/or other types of components, and/or firmware or other software to control the operations of the component(s). In some implementations, determining a correspondence between the sent and received patterns 114 includes calculating a differential between the two patterns 114. The patterns 114 may be determined to correspond if the differential is below a predetermined threshold value. Such a calculation is described further with reference to FIG. 3. Access control based on repetition of the pattern 114 is described further with reference to FIG. 2A.

In some implementations, the pattern entry device 108 may be a numeric keypad or other type of user interface that accepts numeric input. In such implementations, instead of attempting to mimic or repeat the pattern 114(1), the individual 102 may enter into the pattern entry device 108 a sequence of numbers that corresponds to the pattern 114(1). The sequence of numbers may be communicated as the pattern 114(2) to the access control module(s) 112. A correspondence between the pattern 114(1) and the numeric sequence of the pattern 114(2) may cause the sending of the access signal 116 to open the door 106. Access control based on entering a numeric sequence that corresponds to the pattern 114(1) is described further with reference to FIG. 2B.

In some implementations, if the patterns 114(1) and 114(2) do not correspond to one another the access control module(s) 112 may communicate the access failure to a user device 104 and/or the pattern entry device 108. Another pattern 114(1) may be sent to and played through the user device 104(1), and the individual 102 may again attempt to enter a pattern 114(2) corresponding to the pattern 114(1). In some implementations, the individual 102 may be permitted a certain number of failed access attempts before being locked out of further attempts, either permanently or for a predetermined cool-down period (e.g., five minutes).

In some implementations, additional information may be employed to determine that the individual 102 is actually near the door 106 when attempting to access the secure area through the door 106. For example, location information from a user device 104 may be received by the access control module(s) 112 and employed to confirm that the individual 102 is actually in proximity to the door 106. As another example, one or more external sensors (e.g., camera, heat sensors, motion sensors, etc.) may be positioned in proximity to the door 106 to confirm the presence of the individual 102 at or near the door 106.

The implementations depicted in FIG. 1A may be similarly applied to control operations of a smart appliance, vehicle, or other object. For example, a pattern entry device 108 may be located in the handle of an appliance (e.g., lawnmower) or a vehicle, or in a vehicle steering wheel. The individual 102 may be required to enter a corresponding pattern 114(2) to gain access to the vehicle and/or activate the vehicle and/or appliance. In such examples, the access signal 116 may be sent to an onboard computer in the appliance or vehicle, and the onboard computer may respond to the access signal 116 by activating the appliance or vehicle, or opening the door to the vehicle.

The implementations depicted in FIG. 1A may be similarly applied to authorize a transaction requested by the individual 102, such as a purchase, funds withdrawal, funds transfer, and so forth. In such instances, the pattern entry device 108 may be included in a point-of-sale (POS) terminal, automated teller machine (ATM), vending machine, service kiosk, or other object. The access signal 116 may be sent to the object to indicate that the individual 102 has successfully repeated and/or mimicked the pattern 114(1) in a manner sufficient to authorize the transaction. Such implementations may ensure that the individual 102 who is requesting the transaction is the same individual 102 who is in possession of a registered user device 104(1) and is therefore authorized to conduct transactions.

Figure 1B:
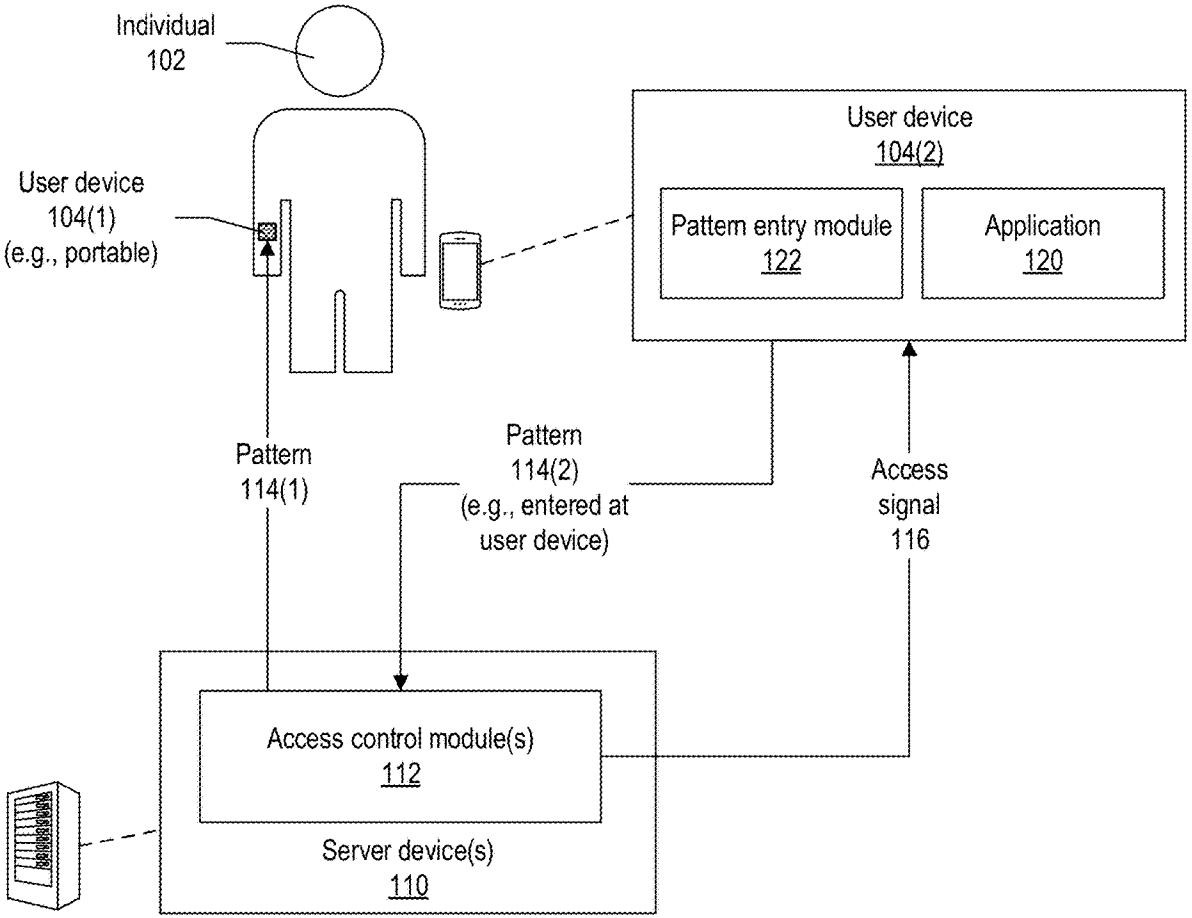
FIG. 1B depicts an example system for using pattern repetition to control access to a computing device and/or application, according to implementations of the present disclosure.

FIG. 1B depicts an example system for using pattern repetition to control access to a user device 104 and/or application 120, according to implementations of the present disclosure. The elements shown in FIG. 1B may be configured similarly to like-numbered elements in FIG. 1A, and/or may perform similar operations as those performed by like-numbered elements in FIG. 1A. In the example of FIG. 1B, pattern repetition may be employed to provide the individual 102 access to (e.g., log in to) an application 120 executing on a user device 104. Similarly, the pattern repetition may be employed to provide the individual 102 access to secure data, secure sections of the application 120, and/or to activate (e.g., unlock) the user device 104.

In the example of FIG. 1B, the pattern 114(1) may be sent to a first user device 104(1) of the individual 102, such as a wearable computing device (e.g., watch, epidermal patch device, etc.). In some instances, the pattern 114(1) may be sent from the access control module(s) 112 in response to an indication that the individual 102 is attempting to login to the application 120 executing on a second user device 104(2) and/or unlock the user device 104(2). The user device 104(2) may be separate from the user device 104(1) and may communicate with the user device 104(1) over a body area network (BAN) and/or personal area network (PAN). Such communications between the user devices 104 may employ a wireless communication protocol such as any suitable version of BlueTooth™, BlueTooth™ Low Energy (BLE), WiFi™ (e.g., IEEE 802.11b, g, n, etc.), near field communication (NFC), and so forth.

On receiving the pattern 114(1), the user device 104(1) may play the pattern as described above. The individual 102 may then repeat the pattern by tapping on a touchscreen, touchpad, and/or other input component of the user device 104(2). A pattern entry module 122 executing on the user device 104(2) may generate a pattern 114(2) based on the individual's tapping, and the pattern 114(2) may be communicated to the access control module(s) 112 on the server device(s) 110. The pattern 114(2) may be compared to the pattern 114(1) as described above, and the access signal 116 may be sent if there is sufficient correspondence between the patterns 114. The access signal 116 may cause the application 120 to allow access to the individual 102. In some examples, the access signal 116 may unlock the user device 104(2) for the individual 102.

In some implementations, the individual 102 may enter the pattern 114(2) as a numeric sequence that corresponds to the pattern 114(1). In such examples, the access control module(s) 112 may determine whether the numeric sequence corresponds to the pattern 114(1) and enable access accordingly.

Although FIGS. 1A and 1B depict examples in which the pattern 114(1) is played through a wearable computing device worn by the individual 102, implementations are not limited to such scenarios. The pattern 114(1) may be played using any appropriate user device 104(1) that is able to product haptic and/or audio output. For example, the pattern 114(1) may be played through a smartphone, tablet computer, and so forth. Moreover, the user device 104(2) of FIG. 1B may be any suitable type of computing device, such as a smartphone, tablet computer, wearable computer, desktop computer, laptop computer, smart appliance, gaming console, and so forth. The user device 104(2) of FIG. 1B may also be an ATM, shopping kiosk, vending machine, and/or other type of device.

Figure 2A:
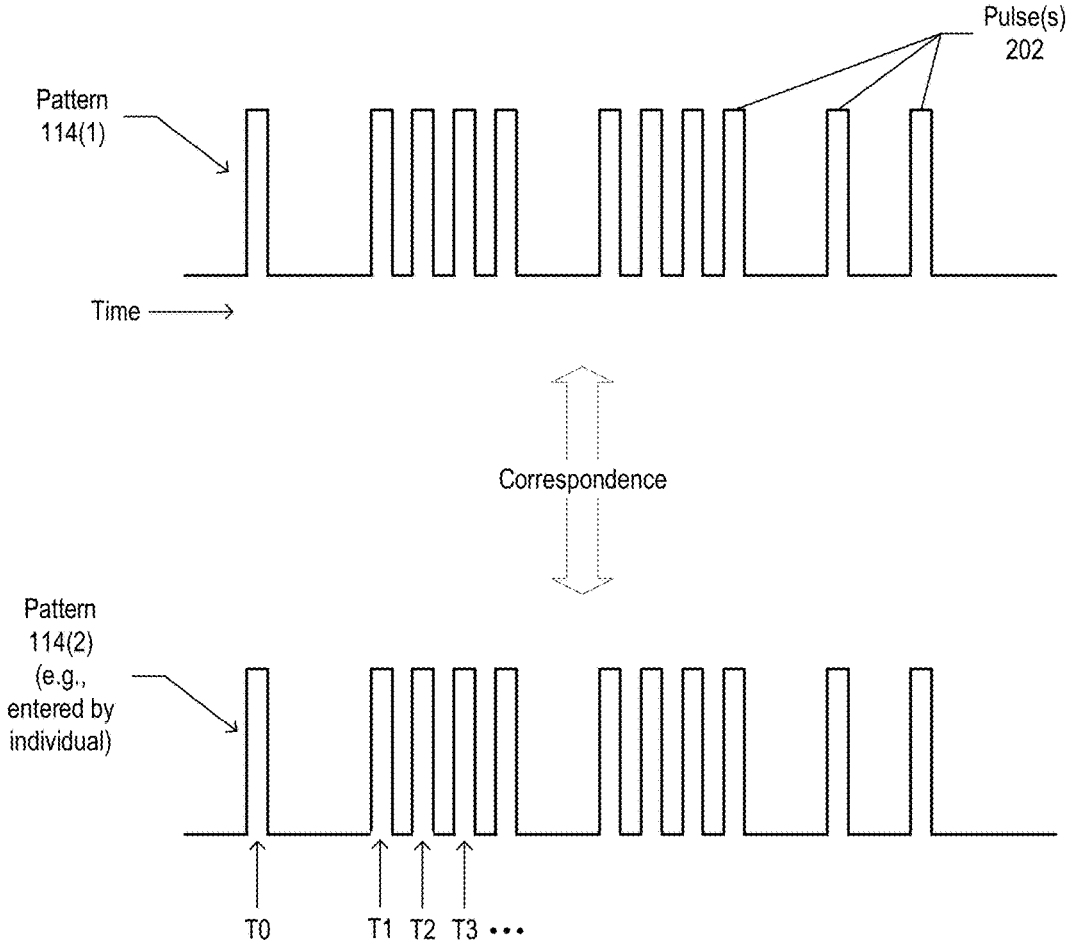
FIG. 2A depicts an example of a pattern correspondence that may be employed for access control, according to implementations of the present disclosure.

FIG. 2A depicts an example of a pattern correspondence that may be employed for access control, according to implementations of the present disclosure. In the example of FIG. 2A, the pattern 114(1) may be a rhythmic pattern of pulses 202 and the individual 102 may repeat or mimic the pattern 114(1) to generate the pattern 114(2). The pattern 114(1) may include any number of pulse(s) 202 that are sufficient to enable the individual 102 to perceive and repeat the pattern 114(1). In the example of FIG. 2A, the pattern 114(1) is: pulse, pause, four pulses in succession, pause, four more pulses in succession, pause, pulse, pause, pulse. Other suitable patterns 114 may be employed. The pattern 114 may play over any suitable duration of time. In some implementations, the pattern 114 may be long enough and may include a sufficient number of pulses 202, in a sufficiently complex pattern, to ensure that the pattern 114 may not be readily guessed by unauthorized individuals. The pattern 114 may be short enough and may include a sufficiently limited number of pulses 202, in a pattern that is not too complex, to ensure that pattern is readily perceivable and repeatable by the authorized individual 102. For example, the pattern 114 may span a time duration of approximately 5 seconds, and may include between 6 and 12 pulses 202. In some implementations, the pattern 114(1) may be played on the user device 104(1) multiple times to ensure that the individual 102 is able to perceive and remember the pattern 114(1).

A correspondence may be determined between the patterns 114(1) and 114(2) of the pattern 114(2) is sufficiently duplicative or similar to the pattern 114(1). In some implementations, a differential may be calculated or otherwise determined that provides a measure of the difference between the patterns 114(1) and 114(2). Implementations support the use of any suitable statistical measure of the difference between the patterns 114(1) and 114(2). For example, the differential may be calculated as a sum of the differences between the times T1, T2, T3, and so forth of the pulses 202 in the two patterns, where the times are relative to a time TO of the first pulse 202 in a pattern. As another example, the differential may be calculated as a root mean square of the differences in the times of the pulses in each pattern. A positive correspondence between the two patterns 114(1) and 114(2) may be determined if the differential is below a predetermined threshold value.

Figure 2B:
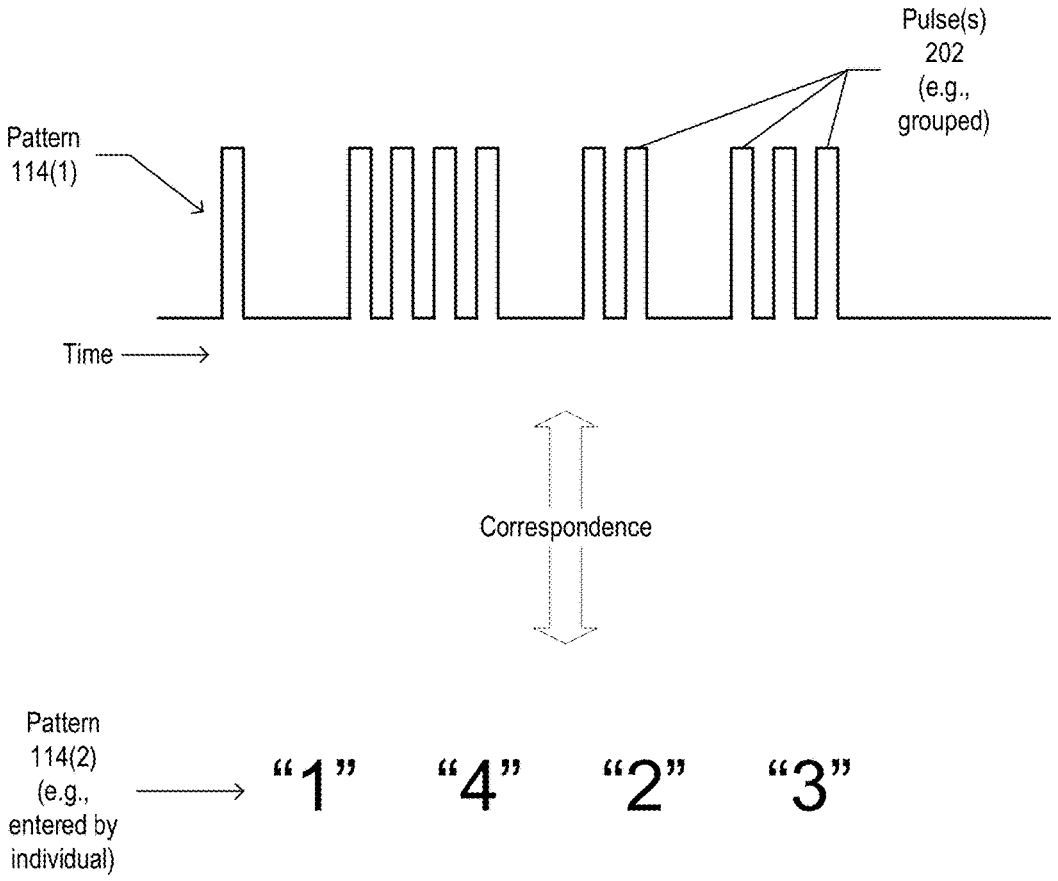
FIG. 2B depicts an example of a pattern correspondence that may be employed for access control, according to implementations of the present disclosure.

FIG. 2B depicts an example of a pattern correspondence that may be employed for access control, according to implementations of the present disclosure. In the example of FIG. 2B, the pattern 114(1) may be a rhythmic pattern of pulses 202 arranged into a plurality of groups. The individual 102 may enter the pattern 114(2) as a numeric sequence, where each number in the sequence corresponds to the number of pulses 202 in a particular group. The pattern 114(1) may include any number of pulse(s) 202, in any number of groups, that are sufficient to enable the individual 102 to perceive and repeat the pattern 114(1). In the example of FIG. 2B, the pattern 114(1) is: pulse (e.g., first group), pause, four pulses in succession (e.g., second group), pause, two more pulses in succession (e.g., third group), pause, three pulses in succession (e.g., fourth group). Other suitable patterns 114 may be employed. In some implementations, the pattern 114 may be long enough and may include a sufficient number of groups of pulses 202 to ensure that the pattern 114 may not be readily guessed by unauthorized individuals. The pattern 114 may be short enough and may include a sufficiently limited number of groups of pulses 202 to ensure that pattern is readily perceivable and repeatable by the authorized individual 102. In the example of FIG. 2B, the corresponding pattern 114(2) is "1", "4", "2", "3", given that the pattern 114(1) includes four groups of pulses 202 that include 1, 4, 2, and 3 pulses respectively.

In implementations where the pattern 114(2) is a numeric sequence as in the example of FIG. 2B, a correspondence may be determined between the patterns 114 if the numeric sequence correctly indicates the number of pulses 202 in each group included in the pattern 114(1). In some implementations, some deviation may be allowed while still finding a correspondence. For example, the numeric sequence may be within a threshold of plus or minus 1 of the correct number of pulses 202 in each group.

Figure 3:
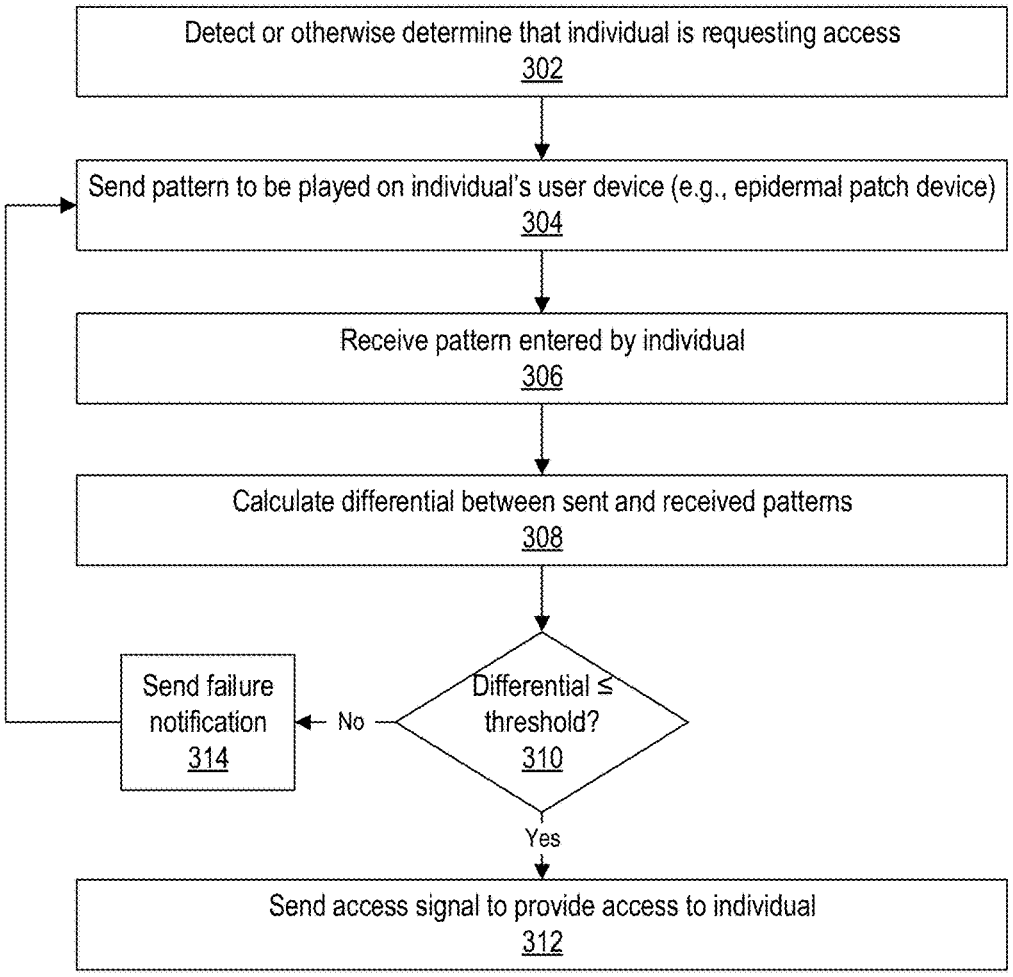
FIG. 3 depicts a flow diagram of an example process for controlling access based on pattern repetition, according to implementations of the present disclosure.

FIG. 3 depicts a flow diagram of an example process for controlling access based on pattern repetition, according to implementations of the present disclosure. Operations of the process may be performed by one or more of the access control module(s) 112, the application 120, and/or other software module(s) executing on the user device(s) 104, the server device(s) 110, the door controller 118, or elsewhere.

A determination may be made that an individual 102 is requesting access (302). In implementations as in the example of FIG. 1A, the determination may be based on detecting that the individual's location is in proximity to or approaching a door 106 or other secure access point. In implementations as in the example of FIG. 1B, the determination may be based on detecting that the individual 102 is attempt to unlock a user device 104(2), log in to an application 120 on a user device 104(2), or attempting to access a secure portion of the application 120, secure data, or other types of access-controlled information.

In response to the detection and/or determination of 302, the pattern 114(1) may be generated and sent (304) to the user device 104(1), to be played by the user device 104(1) as audio and/or haptic output. In some implementations, the pattern 114(1) may be randomly generated within particular parameters for length (e.g., time duration), possible range of number of pulses, complexity of the pattern (e.g., as in FIG. 2A), number of groups in the pattern (e.g., as in FIG. 2B), and/or other parameters.

The pattern 114(2) entered by the individual 102 may be received (306). The two patterns 114 may be compared as described above to determine whether there is a correspondence. In some implementations, a differential may be calculated (308) as described above. If the differential is at or below a predetermined threshold value (310), or if a positive correspondence is otherwise determined, the access signal 116 may be sent (312) to provide access to the individual 102 as described above.

If the differential is above the predetermined threshold value, or if a negative (lack of) correspondence is otherwise determined, a failure notification may be sent (314) and presented on a user device 104 and/or the pattern entry device 108. In some implementations, the process may return to 304 and allow the individual 102 at least one additional attempt to replicate the pattern 114. In some implementations, the individual 102 may be allowed a predetermined number of failed attempts before the individual 102 is locked out of access permanently or for a cool-down period (e.g., five minutes). In some implementations, an additional attempt may involve the same pattern 114(1) which is replayed for the individual 102 on the user device 104(1). In some implementations, a different pattern 114(1) may be generated and sent to the user device 104(1) for the additional attempt.

Implementations may enable access based on pattern repetition as described above. In some instances, the pattern repetition may be employed in combination with other forms of user authentication to achieve greater confidence that the individual 102 is authorized to access the secure physical area, application, device, and/or other secure information. For example, the pattern repetition may be employed in combination with credential-based authentication using a login, password, PIN, knowledge-based question answers, and/or other types of credentials, token-based authentication (e.g., OAuth), and so forth. The pattern repetition may also be employed in combination with one or more forms of biometric authentication, such as authentication based on fingerprints, retinal scans, heartbeat detection, neural activity (e.g., brain wave) patterns, voice print analysis, body chemistry measurement, facial recognition, and so forth.

Figure 4:
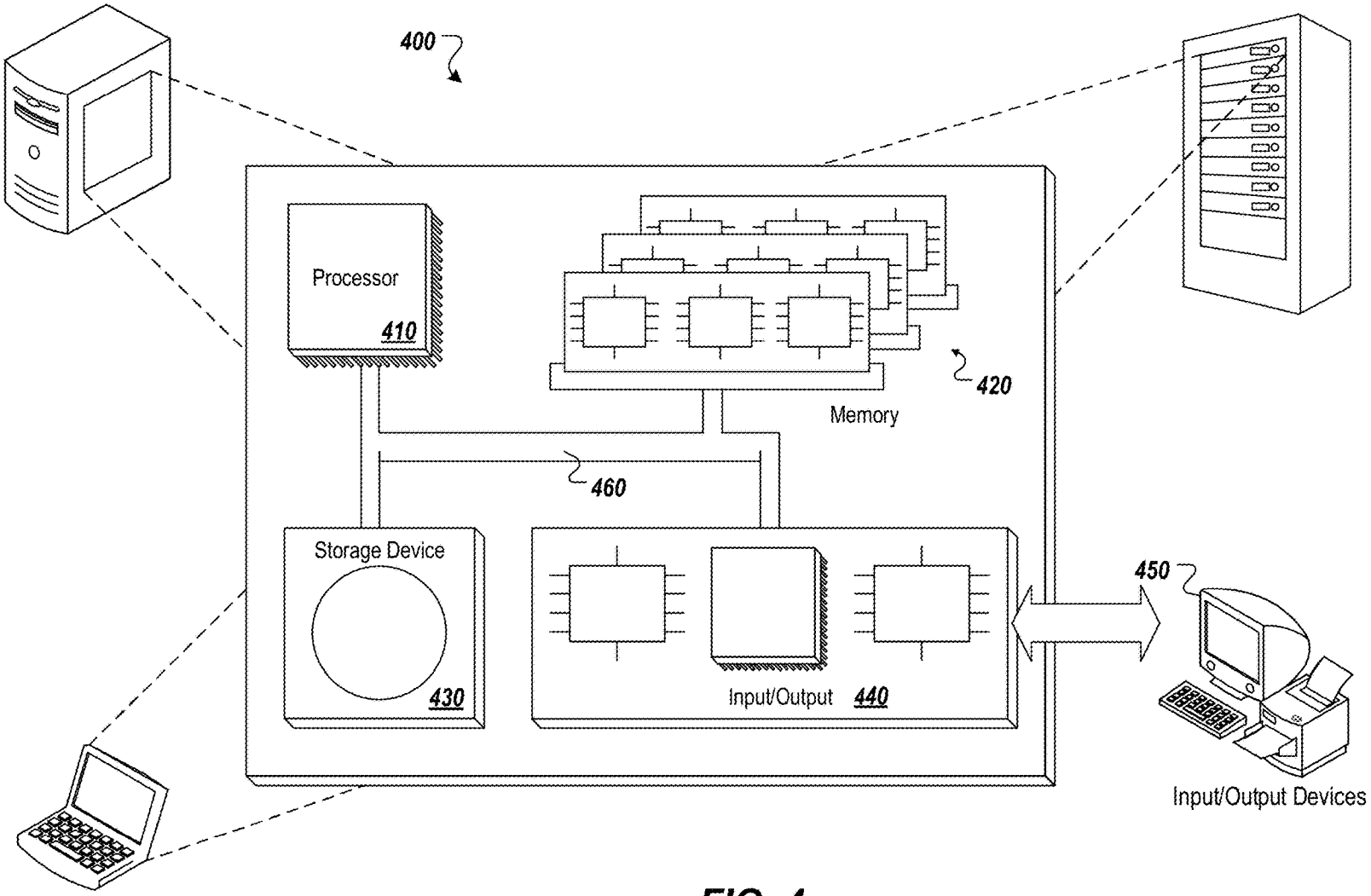
FIG. 4 depicts an example computing system, according to implementations of the present disclosure.

FIG. 4 depicts an example computing system, according to implementations of the present disclosure. The system 400 may be used for any of the operations described with respect to the various implementations discussed herein. For example, the system 400 may be included, at least in part, in one or more of the user device(s) 104, the server device(s) 110, the door controller 118, and/or other device(s) described herein. The system 400 may include one or more processors 410, a memory 420, one or more storage devices 430, and one or more input/output (I/O) devices 450 controllable through one or more I/O interfaces 440. The various components 410, 420, 430, 440, or 450 may be interconnected through at least one system bus 460, which may enable the transfer of data between the various modules and components of the system 400.

The processor(s) 410 may be configured to process instructions for execution within the system 400. The processor(s) 410 may include single-threaded processor(s), multi-threaded processor(s), or both. The processor(s) 410 may be configured to process instructions stored in the memory 420 or on the storage device(s) 430. The processor(s) 410 may include hardware-based processor(s) each including one or more cores. The processor(s) 410 may include general purpose processor(s), special purpose processor(s), or both.

The memory 420 may store information within the system 400. In some implementations, the memory 420 includes one or more computer-readable media. The memory 420 may include any number of volatile memory units, any number of non-volatile memory units, or both volatile and non-volatile memory units. The memory 420 may include read-only memory, random access memory, or both. In some examples, the memory 420 may be employed as active or physical memory by one or more executing software modules.

The storage device(s) 430 may be configured to provide (e.g., persistent) mass storage for the system 400. In some implementations, the storage device(s) 430 may include one or more computer-readable media. For example, the storage device(s) 430 may include a floppy disk device, a hard disk device, an optical disk device, or a tape device. The storage device(s) 430 may include read-only memory, random access memory, or both. The storage device(s) 430 may include one or more of an internal hard drive, an external hard drive, or a removable drive.

One or both of the memory 420 or the storage device(s) 430 may include one or more computer-readable storage media (CRSM). The CRSM may include one or more of an electronic storage medium, a magnetic storage medium, an optical storage medium, a magneto-optical storage medium, a quantum storage medium, a mechanical computer storage medium, and so forth. The CRSM may provide storage of computer-readable instructions describing data structures, processes, applications, programs, other modules, or other data for the operation of the system 400. In some implementations, the CRSM may include a data store that provides storage of computer-readable instructions or other information in a non-transitory format. The CRSM may be incorporated into the system 400 or may be external with respect to the system 400. The CRSM may include read-only memory, random access memory, or both. One or more CRSM suitable for tangibly embodying computer program instructions and data may include any type of non-volatile memory, including but not limited to: semiconductor memory devices, such as EPROM, EEPROM, and flash memory devices; magnetic disks such as internal hard disks and removable disks; magneto-optical disks; and CD-ROM and DVD-ROM disks. In some examples, the processor(s) 410 and the memory 420 may be supplemented by, or incorporated into, one or more application-specific integrated circuits (ASICs).

The system 400 may include one or more I/0 devices 450. The I/O device(s) 450 may include one or more input devices such as a keyboard, a mouse, a pen, a game controller, a touch input device, an audio input device (e.g., a microphone), a gestural input device, a haptic input device, an image or video capture device (e.g., a camera), or other devices. In some examples, the I/O device(s) 450 may also include one or more output devices such as a display, LED(s), an audio output device (e.g., a speaker), a printer, a haptic output device, and so forth. The I/O device(s) 450 may be physically incorporated in one or more computing devices of the system 400, or may be external with respect to one or more computing devices of the system 400.

The system 400 may include one or more I/O interfaces 440 to enable components or modules of the system 400 to control, interface with, or otherwise communicate with the I/O device(s) 450. The I/O interface(s) 440 may enable information to be transferred in or out of the system 400, or between components of the system 400, through serial communication, parallel communication, or other types of communication. For example, the I/O interface(s) 440 may comply with a version of the RS-232 standard for serial ports, or with a version of the IEEE 1284 standard for parallel ports. As another example, the I/O interface(s) 440 may be configured to provide a connection over Universal Serial Bus (USB) or Ethernet. In some examples, the I/O interface(s) 440 may be configured to provide a serial connection that is compliant with a version of the IEEE 1394 standard.

The I/O interface(s) 440 may also include one or more network interfaces that enable communications between computing devices in the system 400, or between the system 400 and other network-connected computing systems. The network interface(s) may include one or more network interface controllers (NICs) or other types of transceiver devices configured to send and receive communications over one or more networks using any network protocol.

Computing devices of the system 400 may communicate with one another, or with other computing devices, using one or more networks. Such networks may include public networks such as the internet, private networks such as an institutional or personal intranet, or any combination of private and public networks. The networks may include any type of wired or wireless network, including but not limited to local area networks (LANs), wide area networks (WANs), wireless WANs (WWANs), wireless LANs (WLANs), mobile communications networks (e.g., 3G, 4G, Edge, etc.), and so forth. In some implementations, the communications between computing devices may be encrypted or otherwise secured. For example, communications may employ one or more public or private cryptographic keys, ciphers, digital certificates, or other credentials supported by a security protocol, such as any version of the Secure Sockets Layer (SSL) or the Transport Layer Security (TLS) protocol.

The system 400 may include any number of computing devices of any type. The computing device(s) may include, but are not limited to: a personal computer, a smartphone, a tablet computer, a wearable computer, an implanted computer, a mobile gaming device, an electronic book reader, an automotive computer, a desktop computer, a laptop computer, a notebook computer, a game console, a home entertainment device, a network computer, a server computer, a mainframe computer, a distributed computing device (e.g., a cloud computing device), a microcomputer, a system on a chip (SoC), a system in a package (SiP), and so forth. Although examples herein may describe computing device(s) as physical device(s), implementations are not so limited. In some examples, a computing device may include one or more of a virtual computing environment, a hypervisor, an emulation, or a virtual machine executing on one or more physical computing devices. In some examples, two or more computing devices may include a cluster, cloud, farm, or other grouping of multiple devices that coordinate operations to provide load balancing, failover support, parallel processing capabilities, shared storage resources, shared networking capabilities, or other aspects.

Implementations and all of the functional operations described in this specification may be realized in digital electronic circuitry, or in computer software, firmware, or hardware, including the structures disclosed in this specification and their structural equivalents, or in combinations of one or more of them. Implementations may be realized as one or more computer program products, i.e., one or more modules of computer program instructions encoded on a computer readable medium for execution by, or to control the operation of, data processing apparatus. The computer readable medium may be a machine-readable storage device, a machine-readable storage substrate, a memory device, a composition of matter effecting a machine-readable propagated signal, or a combination of one or more of them. The term "computing system" encompasses all apparatus, devices, and machines for processing data, including by way of example a programmable processor, a computer, or multiple processors or computers. The apparatus may include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as a program, software, software application, script, or code) may be written in any appropriate form of programming language, including compiled or interpreted languages, and it may be deployed in any appropriate form, including as a standalone program or as a module, component, subroutine, or other unit suitable for use in a computing environment. A computer program does not necessarily correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one computer or on multiple computers that are located at one site or distributed across multiple sites and interconnected by a communication network.

The processes and logic flows described in this specification may be performed by one or more programmable processors executing one or more computer programs to perform functions by operating on input data and generating output. The processes and logic flows may also be performed by, and apparatus may also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any appropriate kind of digital computer. Generally, a processor may receive instructions and data from a read only memory or a random access memory or both. Elements of a computer can include a processor for performing instructions and one or more memory devices for storing instructions and data. Generally, a computer may also include, or be operatively coupled to receive data from or transfer data to, or both, one or more mass storage devices for storing data, e.g., magnetic, magneto optical disks, or optical disks. However, a computer need not have such devices. Moreover, a computer may be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory may be supplemented by, or incorporated in, special purpose logic circuitry.

To provide for interaction with a user, implementations may be realized on a computer having a display device, e.g., a CRT (cathode ray tube) or LCD (liquid crystal display) monitor, for displaying information to the user and a keyboard and a pointing device, e.g., a mouse or a trackball, by which the user may provide input to the computer. Other kinds of devices may be used to provide for interaction with a user as well; for example, feedback provided to the user may be any appropriate form of sensory feedback, e.g., visual feedback, auditory feedback, or tactile feedback; and input from the user may be received in any appropriate form, including acoustic, speech, or tactile input.

Implementations may be realized in a computing system that includes a back end component, e.g., as a data server, or that includes a middleware component, e.g., an application server, or that includes a front end component, e.g., a client computer having a graphical UI or a web browser through which a user may interact with an implementation, or any appropriate combination of one or more such back end, middleware, or front end components. The components of the system may be interconnected by any appropriate form or medium of digital data communication, e.g., a communication network. Examples of communication networks include a local area network ("LAN") and a wide area network ("WAN"), e.g., the Internet.

The computing system may include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some examples be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems may generally be integrated together in a single software product or packaged into multiple software products.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claims.

What is claimed is:

1. A method performed by at least one processor, the method comprising:

receiving, by the at least one processor, from a first user device, a request to access secure information through the first user device and, in response, sending a first pattern to be output through a second user device, the first pattern including a plurality of pulses;

receiving, by the at least one processor, from the first user device, a second pattern that is entered through the first user device as an attempt to repeat the first pattern output through the second user device; and based at least partly on a correspondence between the first pattern and the second pattern, communicating, by the at least one processor, an access signal to the first user device indicating authorization to access the secure information through the first user device.

2. The method of claim 1, wherein the access signal indicates authorization to access at least one secure portion of an application that executes on the first user device.

3. The method of claim 2, wherein the at least one secure portion of the application includes a secure feature to request a transaction.

4. The method of claim 1, wherein:

the secure information is stored on the first user device; and the access signal indicates authorization to access the secure information on the first user device.

5. The method of claim 1, wherein the first pattern is output through the second user device as one or more of a haptic output and an audio output.

6. The method of claim 1, wherein:

the first user device includes a touch interface; and the second pattern is generated through user input to the touch interface on the first user device.

7. The method of claim 1, further comprising:

determining, by the at least one processor, a differential between the first pattern and the second pattern; and determining, by the at least one processor, the correspondence between the first pattern and the second pattern based on the differential being at or below a threshold value.

8. The method of claim 1, wherein:

the first pattern includes a plurality of groups of pulses; and the second pattern includes a sequence of a plurality of numbers that each corresponds to a number of pulses in one of the plurality of groups.

9. The method of claim 1, wherein:

the second user device is a wearable computing device in physical contact with a user of the first user device; and the first pattern is output by the second user device as a haptic output that is perceivable by the user.

10. The method of claim 1, wherein the first user device and the second user device are communicatively coupled over a wireless network.

11. A system comprising:

at least one processor; and a memory communicatively coupled to the at least one processor, the memory storing instructions which, when executed by the at least one processor, cause the at least one processor to perform operations comprising:

receiving, from a first user device, a request to access secure information through the first user device and, in response, sending a first pattern to be output through a second user device, the first pattern including a plurality of pulses;

receiving, from the first user device, a second pattern that is entered through the first user device as an attempt to repeat the first pattern output through the second user device; and based at least partly on a correspondence between the first pattern and the second pattern, communicating an access signal to the first user device indicating authorization to access the secure information through the first user device.

12. The system of claim 11, wherein the access signal indicates authorization to access at least one secure portion of an application that executes on the first user device.

13. The system of claim 12, wherein the at least one secure portion of the application includes a secure feature to request a transaction.

14. The system of claim 11, wherein:

the secure information is stored on the first user device; and the access signal indicates authorization to access the secure information on the first user device.

15. The system of claim 11, wherein the first pattern is output through the second user device as one or more of a haptic output and an audio output.

16. The system of claim 11, wherein:

the first user device includes a touch interface; and the second pattern is generated through user input to the touch interface on the first user device.

17. The system of claim 11, the operations further comprising:

determining a differential between the first pattern and the second pattern; and determining the correspondence between the first pattern and the second pattern based on the differential being at or below a threshold value.

18. The system of claim 11, wherein:

the first pattern includes a plurality of groups of pulses; and the second pattern includes a sequence of a plurality of numbers that each corresponds to a number of pulses in one of the plurality of groups.

19. The system of claim 11, wherein:

the second user device is a wearable computing device in physical contact with a user of the first user device; and the first pattern is output by the second user device as a haptic output that is perceivable by the user.

20. One or more non-transitory media storing instructions which, when executed by at least one processor, cause the at least one processor to perform operations comprising:

receiving, from a first user device, a request to access secure information through the first user device and, in response, sending a first pattern to be output through a second user device, the first pattern including a plurality of pulses;

receiving, from the first user device, a second pattern that is entered through the first user device as an attempt to repeat the first pattern output through the second user device; and based at least partly on a correspondence between the first pattern and the second pattern, communicating an access signal to the first user device indicating authorization to access the secure information through the first user device.

* * * * *